US006783378B2

(12) United States Patent
Huscher et al.

(10) Patent No.: US 6,783,378 B2
(45) Date of Patent: Aug. 31, 2004

(54) DEVICE FOR TRANSMITTING CURRENT BETWEEN TWO TERMINALS

(75) Inventors: Rainer Huscher, Waldershof (DE); Alexander Steinert, Floss (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/462,613

(22) Filed: Jun. 17, 2003

(65) Prior Publication Data

US 2003/0211765 A1 Nov. 13, 2003

Related U.S. Application Data

(63) Continuation of application No. 10/108,968, filed on Mar. 29, 2002, now Pat. No. 6,663,404.

(30) Foreign Application Priority Data

Mar. 31, 2001 (DE) ..... 101 16 295

(51) Int. Cl.[7] ..... H01R 3/00
(52) U.S. Cl. ..... 439/164; 439/15
(58) Field of Search ..... 439/164, 15; 117/117 F

(56) References Cited

U.S. PATENT DOCUMENTS

| | | | |
|---|---|---|---|
| 4,824,396 | A | 4/1989 | Sasaki et al. |
| 5,139,436 | A | 8/1992 | Bonn et al. |
| 5,210,378 | A | 5/1993 | Tusques |
| 5,226,830 | A | 7/1993 | Ueno |
| 5,230,713 | A | 7/1993 | Schauer |
| 5,238,419 | A | 8/1993 | Roeder et al. |
| 5,246,377 | A | 9/1993 | Kawahara et al. |
| 5,683,259 | A | 11/1997 | Sato |
| 5,702,260 | A | 12/1997 | Kato et al. |
| 5,762,507 | A | 6/1998 | Mochizuki et al. |
| 5,770,818 | A | 6/1998 | Tanaka et al. |
| 5,833,476 | A | 11/1998 | Sakamaki |
| 5,951,311 | A | 9/1999 | Kato et al. |
| 5,962,813 | A | 10/1999 | Shirako et al. |
| 6,023,022 | A | 2/2000 | Nakamura et al. |
| 6,059,591 | A | 5/2000 | Bolen et al. |
| 6,099,331 | A | 8/2000 | Kikkawa et al. |
| 6,109,942 | A | 8/2000 | Bannai |
| 6,247,977 | B1 | 6/2001 | Tanaka et al. |
| 6,325,657 | B1 | 12/2001 | Schore |

FOREIGN PATENT DOCUMENTS

| | | | |
|---|---|---|---|
| DE | 9107726 | U | 9/1991 |
| DE | 91 07 726 | U1 | 9/1991 |
| DE | 195 33 439 | C1 | 2/1997 |
| DE | 198 55 051 | A1 | 6/1999 |
| DE | 199 26 278 | C1 | 2/2001 |
| EP | 0520503 | A2 | 12/1992 |
| EP | 0 834 968 | A2 | 4/1998 |
| EP | 0834968 | A2 | 4/1998 |
| FR | 96 11936 | | 4/1998 |

*Primary Examiner*—Tho D. Ta
*Assistant Examiner*—Larisa Tsukerman
(74) *Attorney, Agent, or Firm*—Sughrue Mion, PLLC

(57) ABSTRACT

A device for transmitting current between two terminals of a cassette (K) between which at least one ribbon cable is arranged that extends in turns. The cassette includes a fixed stator and a rotatable rotor between which the ribbon cable is positioned. One of the two terminals is movable relative to the other. The ribbon cable at its ends is located in the area of the terminals. It is brought out of the cassette at the terminals for the connection of continuing cables (17). At least two plate-shaped contact carriers (18, 19) are mounted to the outside of the stator of the cassette. The conductors of the ribbon cable on the one hand and the conductors of a continuing cable on the other hand can be connected to the contact carriers. The contact carriers are connected with one another by elastic snap-in elements to form a unit.

1 Claim, 4 Drawing Sheets

DEVICE FOR TRANSMITTING CURRENT BETWEEN TWO TERMINALS

This is a continuation of application Ser. No. 10/108,968 filed Mar. 29, 2002; now U.S. Pat. No. 6,663,404 the disclosure of which is incorporated herein by reference.

This application is based on and claims the benefit of German Patent Application No. 10116295.2 filed Mar. 31, 2001, which is incorporated by reference herein.

BACKGROUND OF THE INVENTION

The invention relates to a device, such as disclosed in European patent publication EP 0 834 968 A2, for transmitting current between two terminals, between which is arranged at least one ribbon cable that is accommodated in a cassette and extends in turns, having at least two electrical conductors the length of which is substantially greater than the distance between the two terminals. In this device, the cassette comprises a fixed stator and a rotatable rotor between which the ribbon cable is arranged. At least one of the two terminals is movable relative to the other, and the ribbon cable at its ends located in the area of the terminals is brought out of the cassette.

Such devices are used, for instance, for the power supply of an airbag in a motor vehicle. In this application, the device is built into the steering wheel of the motor vehicle. A significant problem in this and similar devices in general is the current transmission between fixed and movable parts of the device. This problem occurs in all devices with two terminals movable relative to one another, one of which is usually stationary. The sliding contacts or slip rings that are typically used in such cases are subject to wear and are disadvantageous, especially at low amperages, because of their fluctuating contact resistances.

The device known from German patent publication DE 91 07 726 U1 manages without such sliding contacts. In this device, the current is transmitted by a ribbon cable (hereinafter referred to as "FL-BL" for short) which is wound between the terminals in the fashion of a spring barrel of a clock. With a relative rotational movement of the terminals connected by the FL-BL, the FL-BL, which is accommodated in a cassette, "breathes" like the spring of a clock. The turns of the FL-BL are tightened to a smaller diameter in the one direction of rotation. They open out to a larger diameter in the other direction of rotation. The ends of the FL-BL are bent sharply and brought out of the cassette, and serve to connect the FL-BL to a power source on the one hand and to control elements on the other hand. The mechanically sensitive conductors of the FL-BL and the bending point are mechanically protected by a protection element surrounding the ribbon cable. In this device, problems occur when the FL-BL becomes wider because of a greater number of conductors. A correspondingly longer or wider space to lead through the FL-BL surrounded by the protection element is typically not available.

In the known device disclosed in the initially mentioned EP 0 834 968 A2, the ends of the FL-BL are also sharply bent and brought out of the cassette. A protection element surrounding the FL-BL and its bending point is mounted at each end. The protection element, like the ribbon cable, is divided into at least two flat partial elements that extend parallel to one another and in the mounted state fit against one another with their flat sides. This preserves the protection element as mechanical protection of the bent part of FL-BL. To mount the cassette to or inside parts of a steering wheel of a motor vehicle, the length or width of the opening to pass through the protection element may remain unchanged. It has to be widened only slightly so that a protection element consisting of two or more partial elements can be passed through. The at least two-part protection elements are additional elements that have to be fabricated separately.

SUMMARY OF THE INVENTION

The object of the invention is further to develop the initially described device so that it is simpler to produce and mount.

According to the invention, this object is attained by an arrangement wherein

- on the outside of the stator of the cassette at least two plate-shaped contact carriers are mounted, which enclose a clearance to receive mutually insulated electrical contacts to which the conductors of the FL-BL on the one hand and the conductors of at least one continuing electrical cable on the other hand can be connected, and
- the contact carriers as well as any additional contact carriers are connected in piggyback fashion by elastic snap-in elements.

This device can be used largely independently of the number of conductors of the FL-BL. In the finished device, the conductors of the FL-BL are connected to the contacts of at least one contact carrier of the cassette. If, for instance, two contact carriers equipped with contacts are used, the ends of an FL-BL can be divided in accordance with the number of contacts of the two different contact carriers. It is also possible, however, to use two FL-BLs the conductors of which can be connected separately from one another with the contacts of different contact carriers. This is advantageously done at the time when the FL-BL is prepared, prior to fixing the contact carriers to the cassette. The conductors of the FL-BL (one or more than one) can be connected with the contacts of the contact carrier in an electrically conductive manner, e.g., by soldering or welding. A first contact carrier can then be connected either directly to the cassette or to a support mounted thereto. All other contact carriers can for example be snapped onto the first or onto a previously mounted contact carrier in piggyback fashion by means of elastic snap-in elements. The respective unit of contact carriers can be mounted to an end face or a circumferential surface of the cassette. Another essential advantage of this device is that basically the same structure can be used for the cassette with the contact carriers irrespective of the number of conductors of the FL-BL and the continuing cables. Only at least one each of the contact carriers has to be equipped with electrical contacts to connect the corresponding conductors. The second or the additional contact carriers need to carry contacts only if a correspondingly greater number of conductors is to be connected. Accordingly, only as many contacts-which are relatively expensive-are used in the contact carriers as are required to connect the conductors. Thus, it is also possible to build contact carriers without contacts into a unit. The external appearance of the cassette is always the same, no matter how many conductors its FL-BL has.

BRIEF DESCRIPTION OF THE DRAWINGS

Exemplary embodiments of the subject of the invention are illustrated in the drawings, in which FIGS. 1 and 2 schematically show a device according to the invention in two different embodiments.

DETAILED DESCRIPTION OF THE INVENTION

The ribbon cable present inside the cassette can be equipped with round or flat conductors. The flat conductors discussed below are meant to represent either of the two embodiments. For the sake of simplicity, the ribbon cable will still be referred to as "FL-BL." The number of conductors present in the at least one FL-BL inside the cassette is basically discretionary and is limited only by the capacity of the cassette. For their connection with the contacts, the conductors of the FL-BL are in any case connected to at least one contact carrier.

In the exemplary embodiment discussed, the following description assumes that the FL-BL comprises enough conductors that two contact carriers equipped with electrical contacts are used. Advantageously, the contact carriers are identically constructed, with an identical number of contacts. In the finished cassette, these contacts do not all need to be assigned, for instance if there are fewer conductors in the FL-BL than available contacts. It is also possible, however, to use contact carriers with a different number of contacts. For instance, if two separate FL-BLs are present in the cassette, their conductors can be connected separately from one another to one of the contact carriers, respectively. If there is only one FL-BL, it is divided into two separate parts at its ends.

Figure 1:
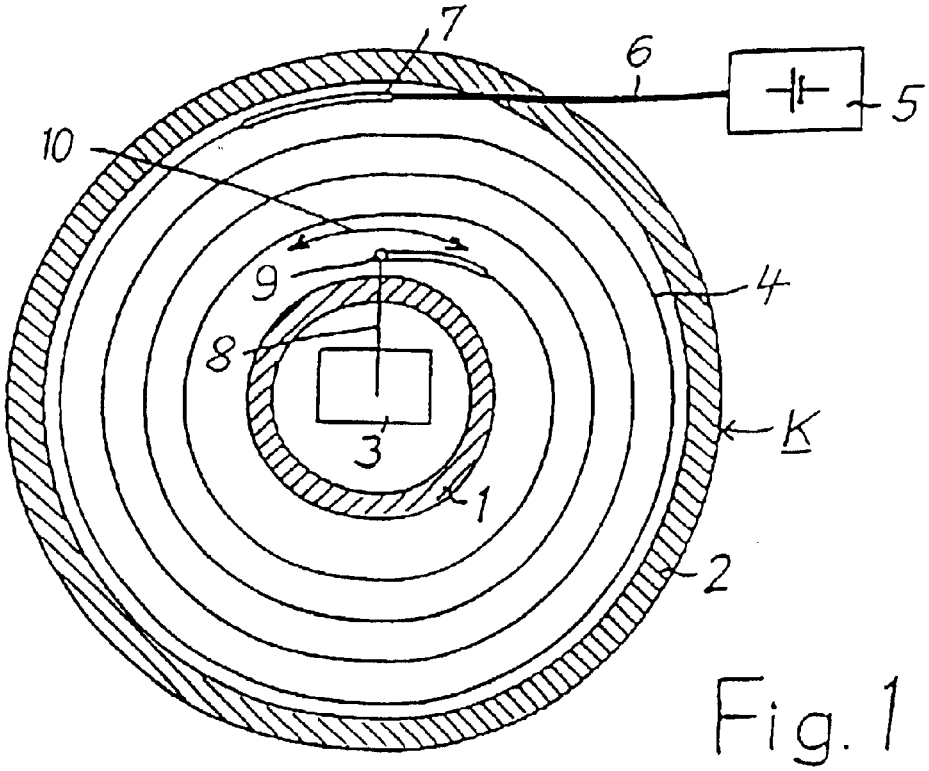
Figure 9:
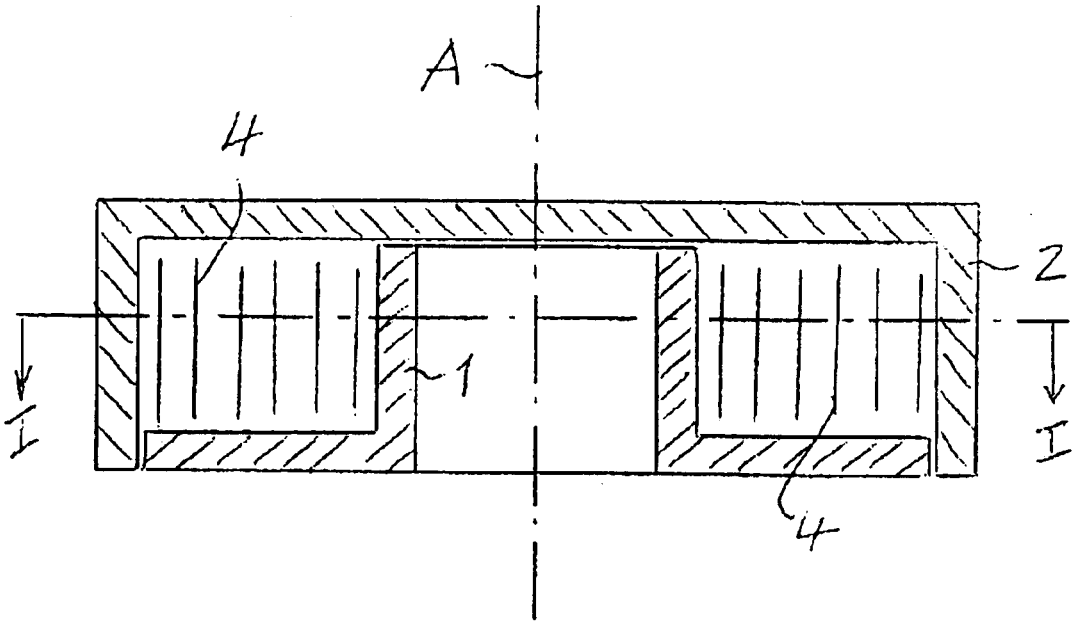
FIG. 9 is a schematic cross-section of FIG. 1.

FIG. 1 schematically depicts two, e.g., circular, walls 1 and 2, of a cassette K, which can be installed in the steering wheel of a motor vehicle, e.g., for the power supply of an airbag. A cross-section along line I—I of the cassette K is illustrated in FIG. 9. Electronics 3, for its power supply, is connected via a FL-BL 4 to a voltage source 5 of the motor vehicle. This voltage source 5 is connected via an electrical cable 6 with a terminal 7, which is embodied as a fixed point. The electronics 3, via an electrical cable 8, is connected to a terminal 9, which can be moved in the direction of the double arrow 10 about rotational axis A (FIG. 9). FL-BL 4 is arranged between the two terminals 7 and 9.

According to FIG. 1, FL-BL 4 may be arranged between the two terminals 7 and 9 in several turns, like a spring barrel of a clock. Although the number of rotations of a steering wheel is limited to about six, substantially more than six turns should be provided for the FL-BL 4. Then the rotary motion of terminal 9 is not very noticeable for an individual turn of FL-BL 4. Only the diameter of the winding consisting of all the turns of the FL-BL 4 is reduced or increased.

Figure 2:
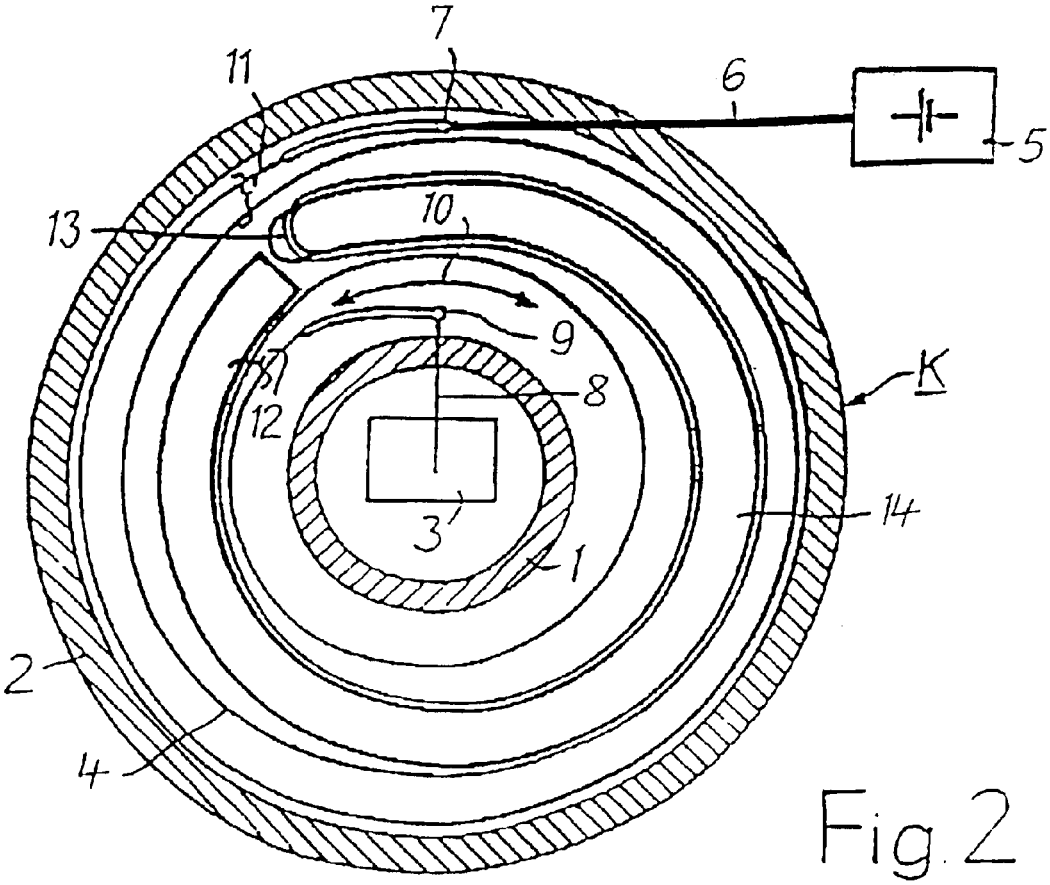

According to FIG. 2, FL-BL 4 may also be arranged inside cassette K in turns that are divided into an outer winding area 11 and an inner winding area 12. The two winding areas 11 and 12 are identified by brackets. They can each have two to three turns. In the two winding areas 11 and 12, the turns of the FL-BL 4 go in opposite winding directions. The winding areas 11 and 12 are connected by an approximately U-shaped reversing point 13. An annular guide element 14, which comprises the reversing point 13, may be mounted between the two winding areas 11 and 12. The guide element 14 can be rotated about its center point and moved in circumferential direction of cassette K, i.e., in the direction of double arrow 10. It is preferably made of plastic so that it will move smoothly inside cassette K.

Figure 3:
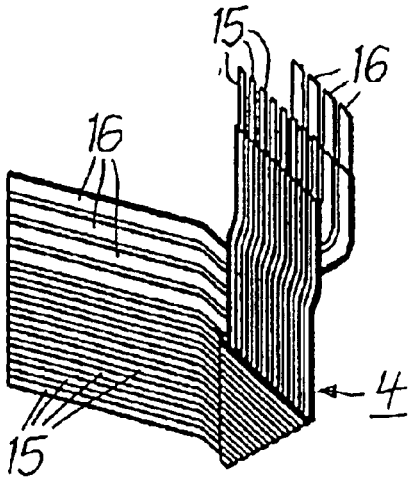
FIG. 3 depicts the end of a ribbon cable that can be used in the device.

The ends of FL-BL 4 are brought out of cassette K in the area of the terminals 7 and 9. As shown in FIG. 3, they may be bent through 90.degree. However, the ends of FL-BL 4 may also be brought out of cassette K in some other manner. FL-BL 4 has for instance twelve conductors 15 and 16 lying side by side, with eight conductors 15 being narrower than the remaining four conductors 16. Due to their different cross section, the conductors 15 and 16 can be used for different functions. At its ends, FL-BL 4 is divided by at least one cut extending in conduction direction. The two parts of FL-BL 4 thus obtained, with conductors 15 on the one hand and conductors 16 on the other hand are bent separately from one another as schematically indicated in FIG. 3.

Figure 4:
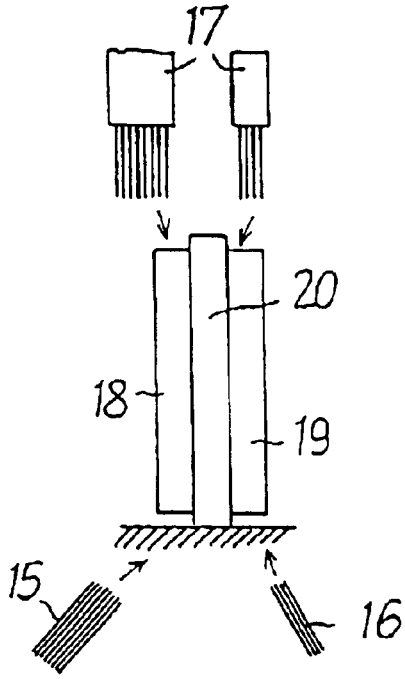
FIG. 4 illustrates an arrangement with contact carriers that can be used in the device.

To connect them to at least one continuing electrical cable 17, the conductors 15 and 16 are connected to two plate-shaped contact carriers 18 and 19, which are mounted to a support 20 as shown in FIG. 4. The conductors 15 are connected, for instance, with contact carrier 18 while the conductors 16 are connected to contact carrier 19 (FIG. 4). The contact carriers 18 and 19 are connected in piggyback fashion to one another and to support 20, which is mounted to cassette K. According to FIG. 5, they may be arranged with any additional piggyback-type contact carriers on an end face of cassette K or its stator. According to FIG. 6, contact carriers 18 and 19 may also be arranged on the circumferential surface of cassette K or its stator. In this case, contact carrier 18, for instance, is fixed to cassette K, while contact carrier 19 may be mounted in piggyback fashion to contact carrier 18 by means of elastic snap-in elements. It may also be arranged in another position, however, on contact carrier 18. This results in a compact unit of contact carriers, which does not require large clearances within the steering wheel of a motor vehicle. This is true particularly also for the arrangement on the circumferential surface of cassette K. The main extension of the contact carrier unit can then lie, e.g., in radial direction.

Figure 7:
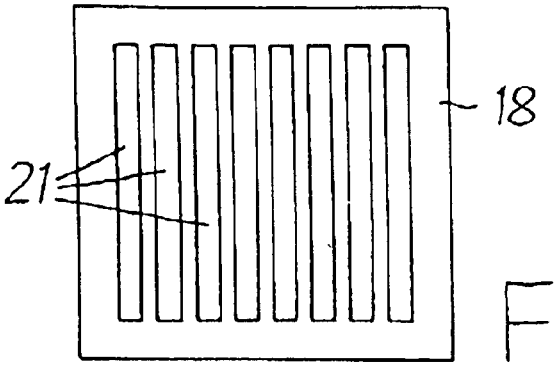
FIG. 7 is an inside view of a contact carrier.

According to FIG. 7, a contact carrier 18, which is equipped with a corresponding clearance, encloses for instance eight mutually insulated electrical contacts 21. These contacts can be, for instance, strips of copper or some other electrically well conducting material, which are arranged parallel and spaced at a distance to one another in the contact carrier 18, which is made of a mechanically stable plastic. On the ends of contacts 21, which in FIG. 7 are the lower ends, e.g., conductors 15 of FL-BL 4 may be fixed in an electrically conductive manner, while on the opposite ends, the top ends in this case, a corresponding number of conductors of the continuing cable 17 are attached. Conductors 15 are preferably connected to these contacts 21 by soldering or welding. The conductors of the continuing cable 17 may also be soldered or welded to contacts 21. These ends of contacts 21, however, may also be embodied as plug-in elements—pins or jacks. The conductors of the continuing cable 17 can then be connected to contacts 21 with complementary plug-in elements. In the FL-BL 4 with four wider conductors 16, as depicted in the exemplary embodiment, the contact carrier 19 needs to have only four contacts.

Figure 5:
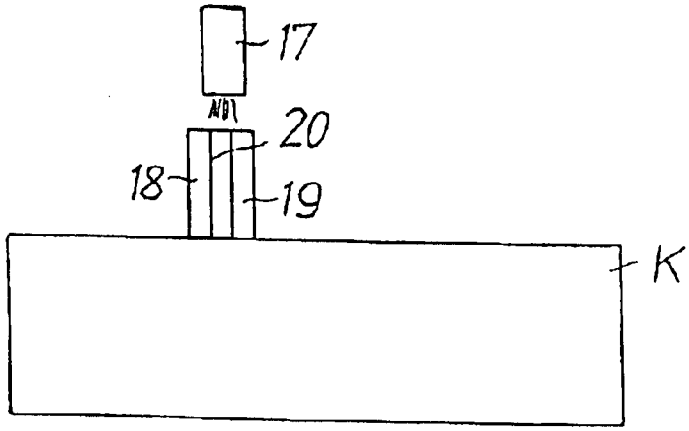
FIGS. 5 and 6 are top views onto the device in two different embodiments.
Figure 8:
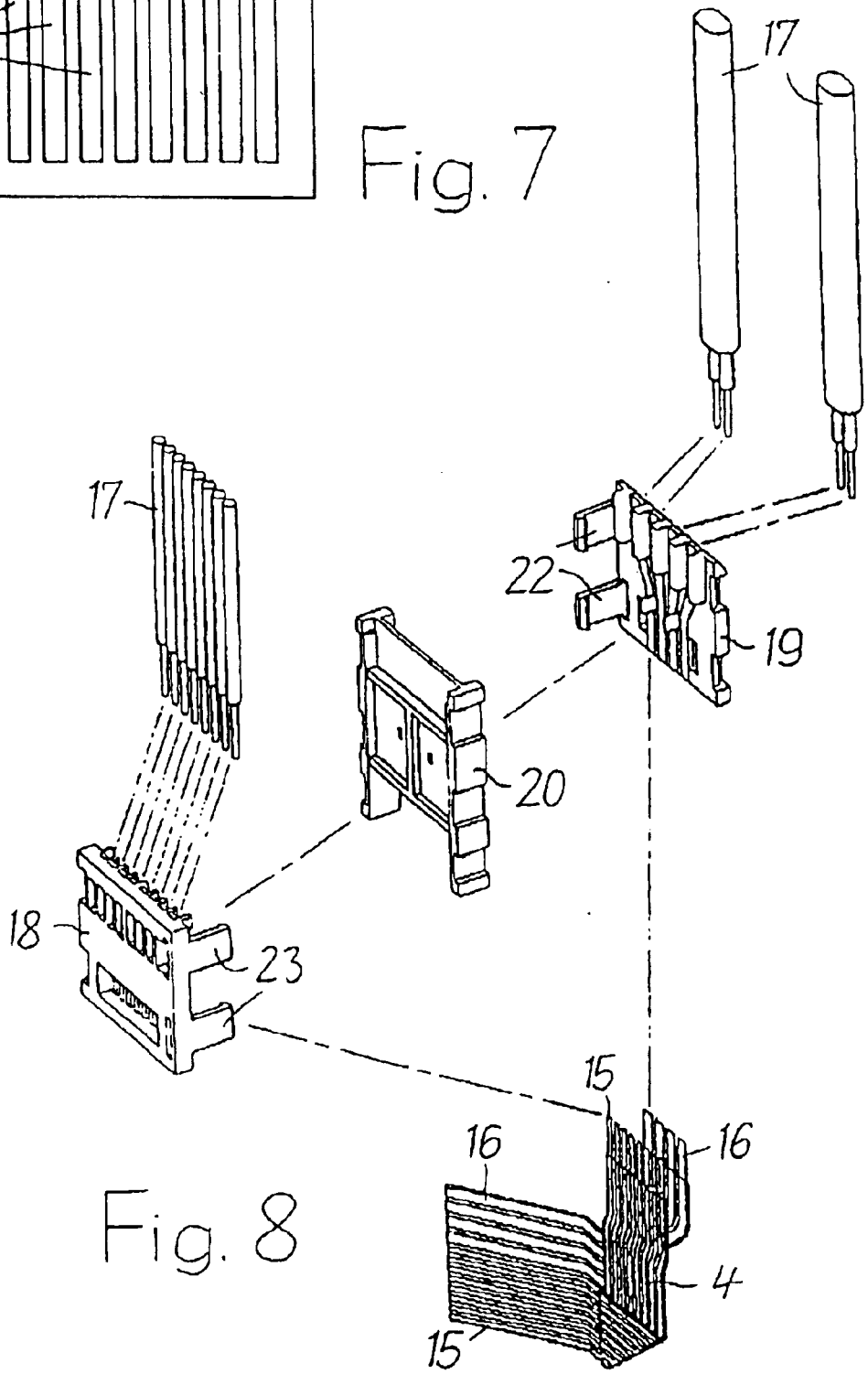
FIG. 8 is an exploded view of a contact carrier and the cables that can be connected thereto.

In the embodiment according to FIG. 5, the two contact carriers 18 and 19 can be fixed to support 20, which is mounted to the end face of cassette K or its stator. They may be attached to support 20 and to one another in piggyback fashion by elastic snap-in elements 22 and 23 (FIG. 8). If additional contact carriers are used, they can likewise be mounted either to contact carrier 18 or to contact carrier 19 by means of elastic snap-in elements. If a separate support 20 is dispensed with, contact carrier 18, for instance, can be fixed to cassette K. Contact carrier 19 and any additional contact carriers are then attached in piggyback fashion as described.

Figure 6:
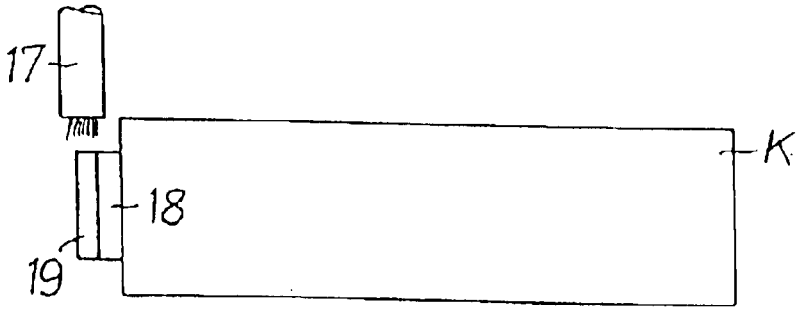

If the contact carriers 18 and 19 are fixed to the circumferential surface of cassette K or its stator as shown in FIG. 6, it is advantageous first to mount contact carrier 18 thereto. Contact carrier 19 and any additional contact carriers are then mounted in piggyback fashion to contact carrier 18 or to the respectively preceding contact carrier. It is also possible, however, to mount contact carrier 19 to what in the drawing is the top or the bottom of contact carrier 18.

Using the example of FIG. 8, cassette K is produced, for instance, as follows:

The ends of conductors 15 and 16 of FL-BL 4 are stripped from their insulation at both ends of FL-BL4. Thereafter, the areas of conductors 15 and 16 are each separated by a cut extending in conduction direction. The two parts of FL-BL 4 thus produced are separately bent through 90.degree. and possibly offset, as shown in FIG. 3 and at the bottom of FIG. 8. Subsequently, conductors 15 are firmly connected with contacts 21 of contact carrier 18 and conductors 16 with the contacts (not depicted) of contact carrier 19, e.g., by soldering or welding.

Thereafter, the conductors of at least one continuing electrical cable 17 (FIG. 8 shows three such cables 17) can be connected in the same manner as conductors 15 and 16 of FL-BL 4 with the respective contacts of contact carriers 18 and 19. If their ends provided for this purpose are made as plug-in elements, they can initially remain free, FL-BL 4 equipped with contact carriers 18 and 19 is finally inserted into a part of cassette K, which is then closed by joining the stator and the rotor. Contact carriers 18 and 19 are subsequently connected with one another by means of the elastic snap-in elements 22 and 23 and are thereby simultaneously fixed to support 20.

In the exemplary embodiment of the device according to the invention described above, said device has two contact carriers 18 and 19 equipped with contacts 21. The device, however, can also have more than two contact carriers of which at least one is equipped with electrical contacts. In cassette K one FL-BL 4 can be arranged. However, there can also be two or more FL-BLs.

What is claimed is:

1. A device for transmitting current between two terminals of a cassette, between which is arranged at least one ribbon cable having at least two electrical conductors that is positioned in the cassette in the form of windings, the length of which therefrom is substantially greater than the distance between the two terminals, in which device the cassette comprises a fixed stator carrying one of the terminals and a rotatable rotor carrying the other terminal between which the ribbon cable is arranged, wherein the ribbon cable, at its ends located in the area of the terminals, is brought out of the cassette, wherein at least two plate-shaped contact carriers (18, 19) are mounted to the outside of the stator of the cassette (K), the carriers enclosing a clearance to receive mutually insulated electrical contacts (21) to which both the conductors (15, 16) of the ribbon cable (4) and the conductors of at least one continuing electrical cable (17) can be connected, and the contact carriers (18, 19) are coupled with one another to form a unit by means of elastic snap-in elements, wherein a first contact carrier (18) is mounted to a circumferential surface of the cassette (K) and at least one additional contact carrier (19) is attached to the first contact carrier (18) in piggyback fashion by means of elastic snap-in elements.

* * * * *